US006012787A

United States Patent [19]

Jennings et al.

[11] Patent Number: 6,012,787

[45] Date of Patent: Jan. 11, 2000

[54] DESK TOP WITH INTERFITTED, MOLDED, UPPER AND LOWER COMPONENTS

[75] Inventors: Roy E. Jennings, Temple, Tex.; John W. Shiffler, Chardon, Ohio

[73] Assignee: Aero Components, Inc., Chardon, Ohio

[21] Appl. No.: 09/168,558

[22] Filed: Oct. 8, 1998

[51] Int. Cl.[7] ..... A47B 96/18

[52] U.S. Cl. ..... 312/140.3; 108/161

[58] Field of Search ..... 108/25, 27, 90, 108/161; 312/140.1, 140.3; 52/782.2, 796.11, 789.1, 792.1, 792.11, 787.1, 793.11

[56] References Cited

U.S. PATENT DOCUMENTS

| | | | |
|---|---|---|---|
| 2,644,733 | 7/1953 | Castle | 108/90 |
| 2,957,737 | 10/1960 | Irwin et al. | 52/782.2 |
| 3,628,832 | 12/1971 | Jennings . | |
| 3,989,212 | 11/1976 | Jennings . | |
| 4,002,369 | 1/1977 | Jennings . | |
| 5,662,841 | 9/1997 | Guergov . | |
| 5,732,637 | 3/1998 | Raab | 108/161 X |
| 5,787,677 | 8/1998 | Bolich et al. | 52/789.1 X |

OTHER PUBLICATIONS

"Manufacturing, A Missing Link is Found in Closed Loop Control", Injection Molding, Jun. 1997, pp. 81–84.

"Novel Injection Control Closes Loop Between Mold Cavity and Nozzle", Modern Plastics, Jun. 1997, pp. 32–33.

"NPE 1997 Highlights", Injection Molding, Aug. 1997, pp. 26–27.

"Injection Molding", Plastics World, Aug. 1997, pp. 14, 16, 24.

"Technology Newsfocus", Plastics Technology, Aug. 1997, p. 9.

*Primary Examiner*—Anthony Knight
*Assistant Examiner*—Karlena D. Schwing
*Attorney, Agent, or Firm*—Brooks & Kushman P.C.

[57] ABSTRACT

A molded desk top construction comprising a desk top upper member having a smooth planar surface, a lower base member supporting the upper member, the members having interlocking peripheral portions which are secured together to provide an integrated, lightweight, impact-resistant, robust desk top. The upper member is comprised of a compression-molded, melamine-covered, polyester thermoset resin. The lower portion is comprised of an injection molded acrylic-butadiene-styrene or high density polypropylene resin.

2 Claims, 2 Drawing Sheets

DESK TOP WITH INTERFITTED, MOLDED, UPPER AND LOWER COMPONENTS

TECHNICAL FIELD

The invention relates to desk tops that are particularly suitable for school classroom use.

BACKGROUND ART

Desk tops for school classroom desks typically are formed with a solid, homogeneous core structure. Although the desk top constructions may provide a smooth and flat working surface, the homogeneous, single-piece construction makes the desk top very heavy, which is an undesirable characteristic for educational furniture for use in a classroom setting. Further, such desk top constructions readily can be damaged if the periphery of the desk top strikes a companion desk or if it strikes the floor. The useful life of such educational furniture thus is often limited because of the structural limitations of the material used in its construction. Further, the cost of manufacture often is unacceptable because of the high cost of materials.

Durability of such prior art constructions can be improved if the thickness of the desk top is increased, but that would increase the weight and make the desk top more prone to damage, especially at the perimeter of the upper writing surface. The single-piece construction of such known desk top designs may make it unfeasible to manufacture educational furniture of a chosen color.

DISCLOSURE OF THE INVENTION

The improved desk top construction of the present invention overcomes the problems usually associated with solid, one-piece desk top constructions made with known manufacturing techniques. The desk top of the present invention is comprised of two main components that are secured together at their peripheries to form a high grade, impact-resistant construction with a smooth writing surface. The desk top components comprise an upper, compression-molded, thermoset resin portion with a molded flange around its perimeter to increase rigidity.

The upper molding provides an excellent desk top surface since it is scratch resistant and its surface is flat and smooth and easy to clean and maintain. It also provides a wide choice of colors and has excellent wearing qualities under the most rigid use to which educational furniture is subjected in a classroom setting. A lower portion of the desk top construction is an injection molding of acrylic-butadiene-styrene (ABS) or high density polypropylene material with a foaming agent throughout its core. The perimeter of the lower portion has a double edge, which serves as a bumper in the event desk tops of adjacent desk units come in contact or if a desk should be tipped over and hit the floor. The lower portion has ribbed sections which support the upper portion thus providing a flat writing surface. The upper and lower portions are held together by suitable fasteners and a suitable thermoset, non-rigid, adhesive along the matching perimeters of the upper and lower portions.

The use of an ABS material in an injection molding process for manufacturing an educational chair has been described in our copending U.S. patent application Ser. No. 09/094,208, filed Jun. 9, 1998, entitled "Method For Manufacturing A Chair Having Separate Moldable Parts". Unlike the molding process described in that patent application, however, the injection molding process used in manufacturing the lower portion of the desk top of the present invention does not use a gas counter-pressure technique. Reference may be made to that patent application for the purpose of supplementing the present disclosure. It is incorporated herein by reference.

BEST MODE FOR CARRYING OUT THE INVENTION

Figure 1:
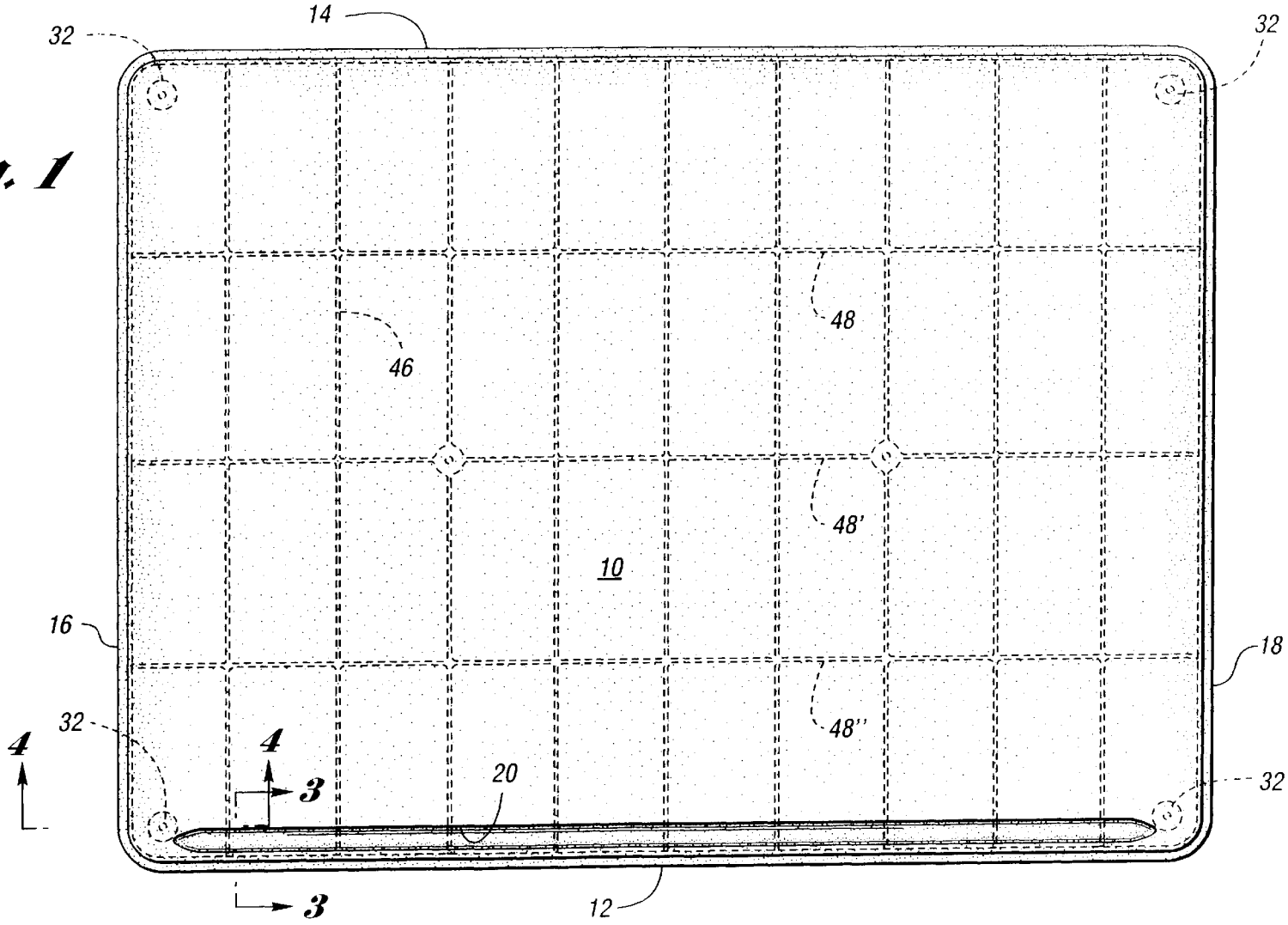
FIG. 1 is a plan view of a desk top incorporating the improvements of the invention.

In FIG. 1, a desk top work surface is shown at 10. The desk top is generally rectangular, the rearward edge being shown at 12 and the forward edge being shown at 14. Left and right side edges are shown at 16 and 18.

A pencil groove 20 is located at the top of the rearward edge 12, as seen in FIG. 1. Although a pencil groove is not illustrated at the forward edge 14, such a pencil groove could be provided if that is desired.

Figure 2:
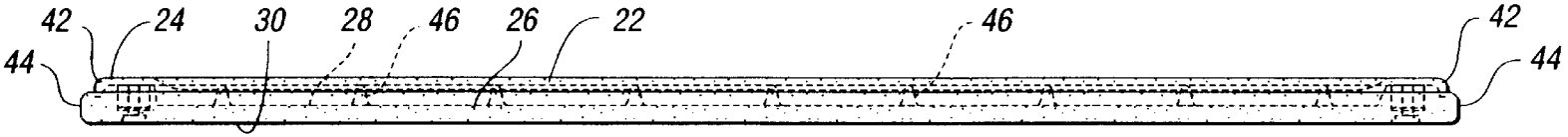
FIG. 2 is a side or edge view of the desk top of FIG. 1 as seen from a rear vantage point.

As seen in FIG. 2, the working surface 10 is defined by an upper portion 22, which has a reduced-thickness peripheral portion 24 engaging the periphery of lower desk top portion 26.

Figure 4:
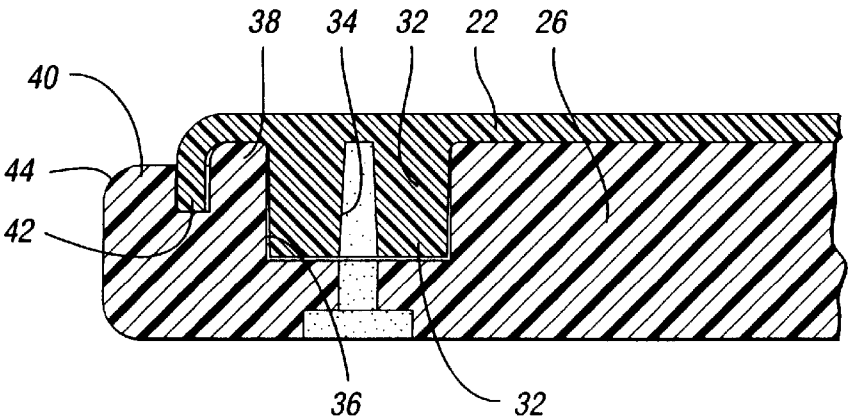
FIG. 4 is a cross-sectional view as seen from the plane of section line 4—4 of FIG. 1.
Figure 3:
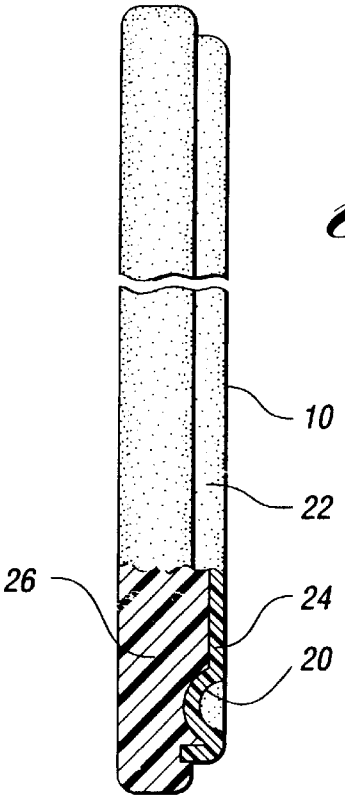
FIG. 3 is a cross-sectional view of one side of the desk top of FIG. 1 as seen from the plane of section line 3—3 of FIG. 1.

Desk top portion 26 is situated below the upper portion 22. It is comprised of an injection molded acrylic-butadiene-styrene (ABS) or high density polypropylene resin material. A foaming agent, such as the foaming agent described in the copending patent application mentioned above, is used during the injection molding process to provide a porous core structure, thereby reducing weight while maintaining structural rigidity. The use of a foaming agent makes it possible to obtain a flat upper surface 28 as well as a flat lower surface 30. The upper member 22, as seen in FIG. 4, has a boss 32 at each of its four corners. The bosses 32 form an integral part of the compression molding for the upper portion 22. They are formed with openings 34 for receiving threaded fasteners which extend through the lower portion 26. Bosses 32, which provide alignment of the upper and lower desk top portions, are received in molded pockets 36 formed during the injection molding process for the lower portion 26.

The periphery of the lower portion 26 has a first raised boss 38 and a second raised boss 40. A peripheral channel situated between the bosses 38 and 40 receives a turned down margin 42 of the upper portion 22.

The upper portion 22 and the lower portion 26 can be secured by threaded fasteners in openings 34 and also by an adhesive such as a polyurethane, thermoset, non-rigid adhesive applied to the peripheral channel.

The peripheral margin of the lower portion 26 extends outwardly from the peripheral margin of the upper portion 22 to define a double radius bull nose 44, which serves as a bumper should the edges of the desk top come in contact with an adjacent desk top or if the desk top should be tipped over and hit the floor. In either case, the margin of the upper portion 22 would be protected against damage.

The upper surface 28 of the lower portion 26 has a series of ribs 46, which extend in a fore-and-aft direction, as indicated best in FIG. 1. In the particular embodiment disclosed, there are nine such fore-and-aft ribs. The ribs 46 are formed integrally with the lower portion 26. The apex of each rib engages the lower surface of the upper portion 22, thereby providing support for the upper portion. This makes it possible to maintain a flat, smooth, work surface 10. The spacing provided by the ribs 46 significantly reduces the weight of the desk top assembly without reducing the rigidity of the assembly.

Lateral ribs 48, 48' and 48" extend from edge 16 to edge 18, as best seen in FIG. 1. These lateral ribs intersect and are formed integrally with the fore-and-aft ribs 46. They are formed during the injection molding procedure for the lower desk top portion 26.

The upper portion of the desk top assembly preferably is made of a melamine resin, which is a high grade, impact-resistant, compression-molded thermoset material. The bosses 32, which are received in the pockets 36, provide alignment. They also provide structure for mounting the desk top on desk support hardware. The melamine provides excellent top surface qualities since it is scratch resistant and its surface is flat and smooth and easy to clean. The use of melamine also makes it possible to choose from a variety of colors. Further, it provides continued long life under the most rigid use. The rounded corners at the turned-down edges 42 of the top portion allow maximum user comfort and will allow the desk top to fit in any classroom environment.

The foaming agent used in the injection molding of the lower desk top portion provides uniform consistency of the molding. It also provides a resilient edge which acts as a bumper. The outward protrusion of the bumper portion 44 from the turned in edge 42 of the upper portion provides protection of the upper portion against damage due to impacts of the desk tops with adjacent furniture.

Since the upper portion and the lower portion are separate moldings, the color of the upper portion can be beige or grey or any other chosen color while the bottom can be black or any other contrasting color that is appropriate for a bumper edge. A choice of colors can be matched to colors chosen for a matching chair, for example, for decoration purposes.

Modifications to the preferred embodiment that is disclosed may be made by persons skilled in the art without departing from the scope of the invention. All such modifications and equivalents thereof are included within the scope of the following claims.

What is claimed is:

1. A desk top construction comprising two interlocking pieces, one of said pieces forming an upper molded portion providing a flat, smooth, writing surface;

the other of said pieces forming a lower molded portion;

said lower portion having integral ribs extending to the upper portion to provide support while defining a lightweight, rigid core structure;

said upper portion being formed of a compression-molded, thermoset resin material and said lower portion being formed of an acrylic-butadiene-styrene (ABS) material;

said two interlocking pieces having peripheries that are secured together to form a rigid desk top assembly with a hollow core defined by said ribs;

a peripheral margin of said lower portion extending outward from said upper portion and overlying the periphery of said upper portion to define a bumper that protects said upper portion against impact damage.

2. The desk top construction of claim 1 wherein the peripheries of said two interlocking pieces are secured together by fasteners and by a non-rigid adhesive.

* * * * *